US005426439A

United States Patent [19]

Grossman

[11] Patent Number: 5,426,439

[45] Date of Patent: Jun. 20, 1995

[54] HORIZONTAL PRINTED CIRCUIT LOOP ANTENNA WITH BALUN, FED WITH COLLINEAR VERTICAL DIPOLE ANTENNA, PROVIDING OMNIDIRECTIONAL DUAL POLARIZATION

[75] Inventor: Ovadia Grossman, Ramat-Gan, Israel

[73] Assignee: Motorola, Inc., Schaumburg, Ill.

[21] Appl. No.: 940,268

[22] Filed: Sep. 2, 1992

[30] Foreign Application Priority Data

Sep. 21, 1991 [GB] United Kingdom ..... 9120201

[51] Int. Cl.[6] ..... H01Q 21/24

[52] U.S. Cl. ..... 343/727; 343/726; 343/797; 343/859

[58] Field of Search ..... 343/741, 744, 726, 729, 343/730, 727, 859, 797; H01Q 21/24

[56] References Cited

U.S. PATENT DOCUMENTS

| | | | |
|---|---|---|---|
| 2,953,782 | 9/1960 | Byatt | 343/726 |
| 3,448,454 | 6/1969 | Lane | 343/742 |
| 4,947,180 | 8/1990 | Schotz | 343/744 |

FOREIGN PATENT DOCUMENTS

| | | | |
|---|---|---|---|
| 2644937 | 9/1990 | France | H01Q 21/24 |
| 3039524 | 5/1981 | Germany | 343/744 |
| 134505 | 8/1983 | Japan | 343/742 |
| 2048571 | 12/1980 | United Kingdom | 343/791 |

*Primary Examiner*—Michael C. Wimer

*Attorney, Agent, or Firm*—Daniel K. Nichols; Pedro P. Hernandez

[57] ABSTRACT

An antenna (10), illustrated in FIG. 3 , comprises a substrate (11), having an upper surface and and a lower surface, and a transformer (14) having a first conducting track (12) formed on the upper surface and a second conducting track (13), mirroring the first conducting track (12), formed on the lower surface, wherein both first and second conducting tracks have an extremity at opposite ends thereof. The antenna (10) further comprises at least one radiating means, comprising a conducting track on the substrate, and an unbalanced line (20) which provides a first potential (21) and a second potential (22). The first potential (21) and the second potential (22) are coupled centrally (30,31) to said first (12) and second (13) conducting tracks respectively. Furthermore, the at least one radiating means is coupled to one of said extremities.

15 Claims, 3 Drawing Sheets

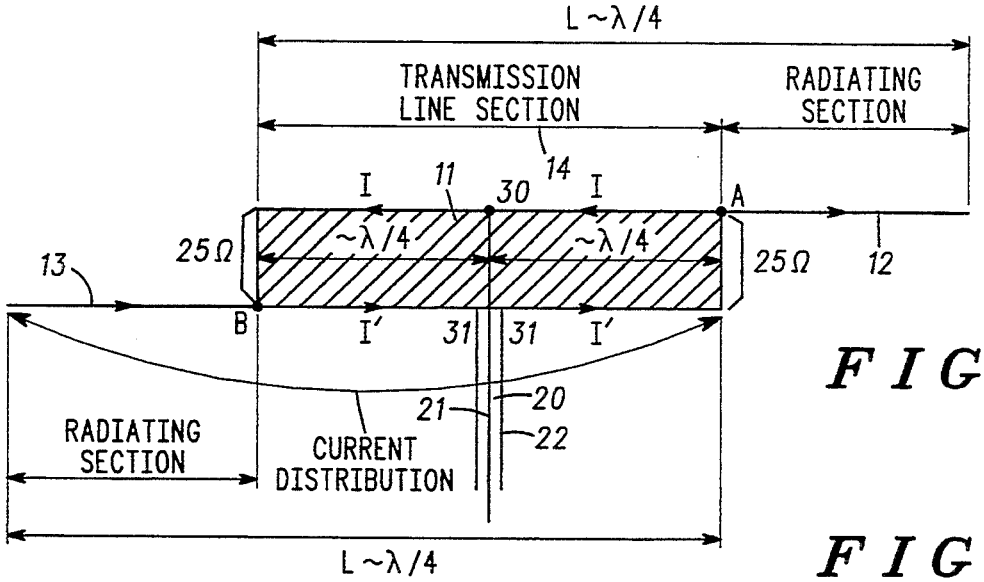
FIG. 3
FIG. 4
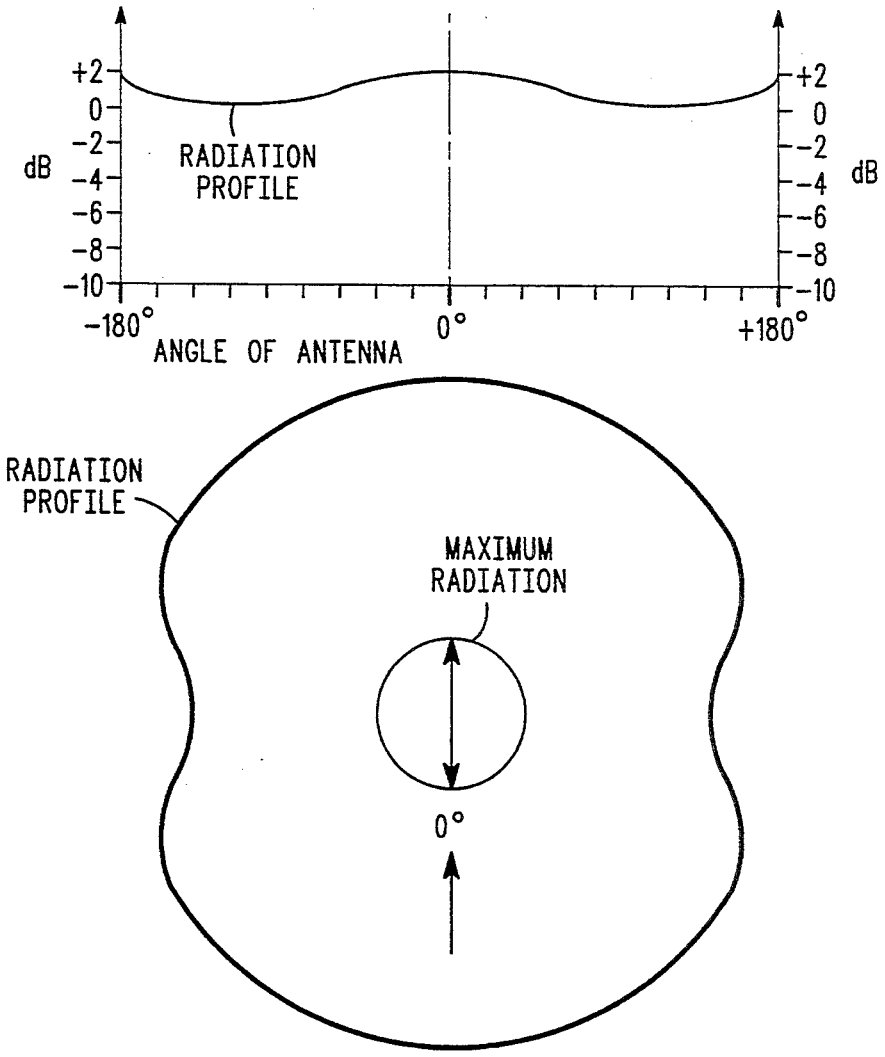

FIG. 6
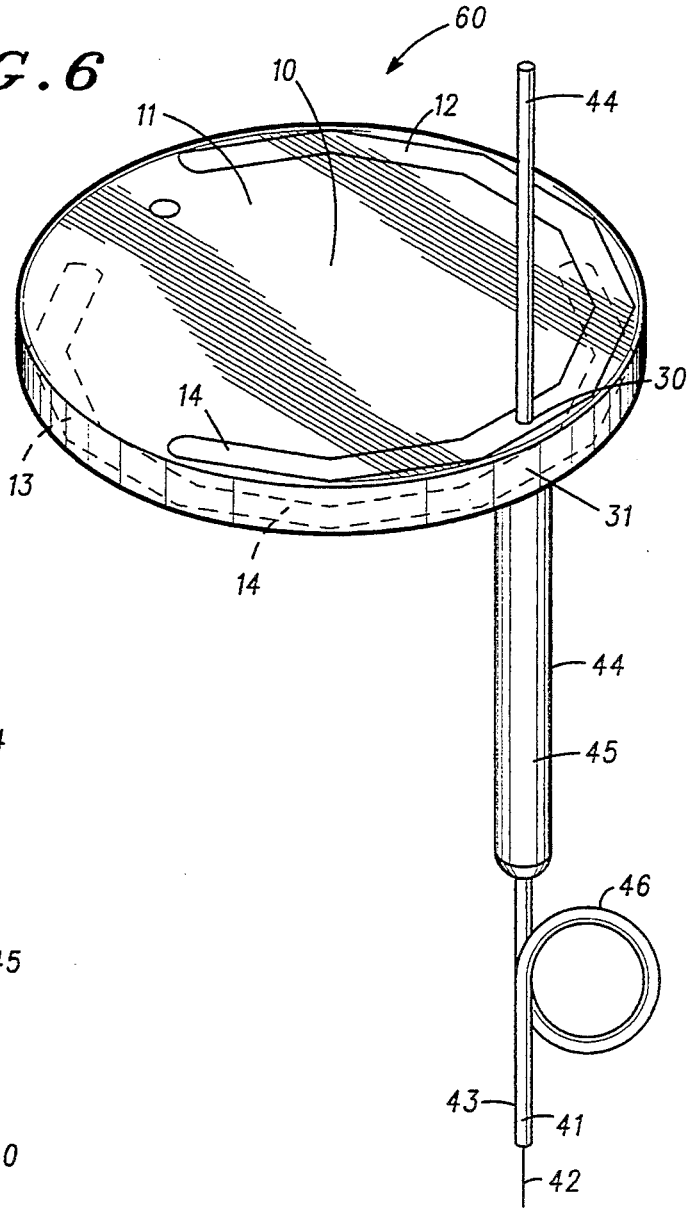
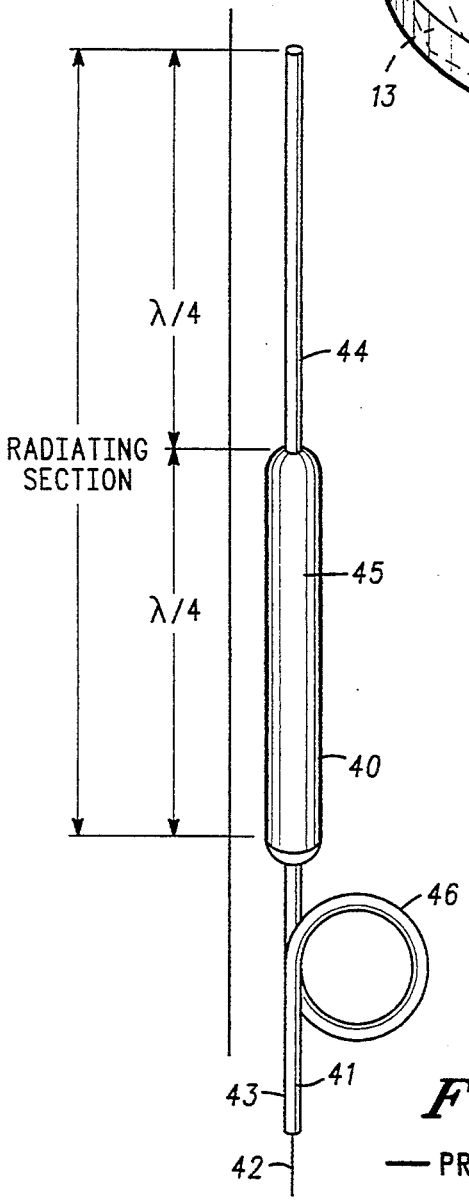
FIG. 5
— PRIOR ART —

HORIZONTAL PRINTED CIRCUIT LOOP ANTENNA WITH BALUN, FED WITH COLLINEAR VERTICAL DIPOLE ANTENNA, PROVIDING OMNIDIRECTIONAL DUAL POLARIZATION

BACKGROUND TO THE INVENTION

This invention relates, in general, to the field of antennas and is particularly, but not exclusively, applicable to the field of high immunity, conformal or concealed antennas.

SUMMARY OF THE PRIOR ART

It is often desirable to mount and/or conceal an antenna inside/beside electrical equipment. This requirement has intrinsic difficulties in that interference from nearby objects is experienced by the antenna. Furthermore, there is a continual trend towards the miniaturisation of antennas to achieve these objectives. However, existing antennas, such as microstrip antennas, may require the use of external couplers and power splitters in order to accomplish dual polarization and noise immunity. These external components not only add to the overall size of the antenna but also detract from the operational efficiency thereof. In addition, the bandwidth of such microstrip antennas is limited to between 2–3% of a central operating frequency, $f_o$. This bandwidth may be increased but there is an escalating cost associated therewith. Other types of antennas require the use of impedance matching components, such as capacitors and inductors. These additional components increase the complexity of antenna design, production process and cost of the antenna. Furthermore, these components also detract from the operational efficiency of the antenna.

It can clearly be appreciated that there is a requirement within the art for an efficient, small, low cost antenna which has limited near field dimensions and, as a consequence, a high immunity to interference from metal objects in particular.

SUMMARY OF THE INVENTION

This invention addresses at least some of the deficiencies which arise in the prior art described above. In accordance with one aspect of the present invention, there is provided an antenna which comprises a substrate, having an upper and a lower surface, and a transformer having a first conducting track formed on the upper surface and a second conducting track, mirroring the first conducting track, formed on the lower surface, wherein both first and second conducting tracks have an extremity at opposite ends thereof. The antenna further comprises at least one radiating means, comprising a conducting track on the substrate, and an unbalanced line which provides a first potential and a second potential. The first potential and the second potential are coupled centrally to said first and second conducting tracks respectively and the at least one radiating means is coupled to one of the extremities.

Preferred and alternative embodiments of the present invention allow for, amongst other things, the production of a horizontally polarized loop antenna and a conformal omnidirectional dual polarization antenna for operation within the frequency range of 800–960 MHz. The loop antenna is formed on a printed circuit board and has a coaxial cable acting as an unbalanced feed line. The dual polarization antenna is formed by directly and centrally coupling the balanced/unbalanced transformer of the loop antenna to a common unbalanced line provided by a prior art collinear dipole antenna.

An exemplary embodiment of the invention will now be described with reference to the accompanying drawings.

BRIEF DESCRIPTION OF THE DRAWINGS

FIG. 3 illustrates a linear model of the antenna of FIG. 1.

FIG. 4 illustrates an empirical azimuthal radiation pattern obtained for the horizontally polarized loop antenna constructed in accordance with the preferred embodiment of FIG. 1.

FIG. 5 illustrates a schematic drawing of a prior art quarter wavelength collinear dipole antenna.

FIG. 6 illustrates a conformal omnidirectional dual polarization antenna in accordance with the present invention.

DETAILED DESCRIPTION OF THE PREFERRED EMBODIMENT

Figure 1:
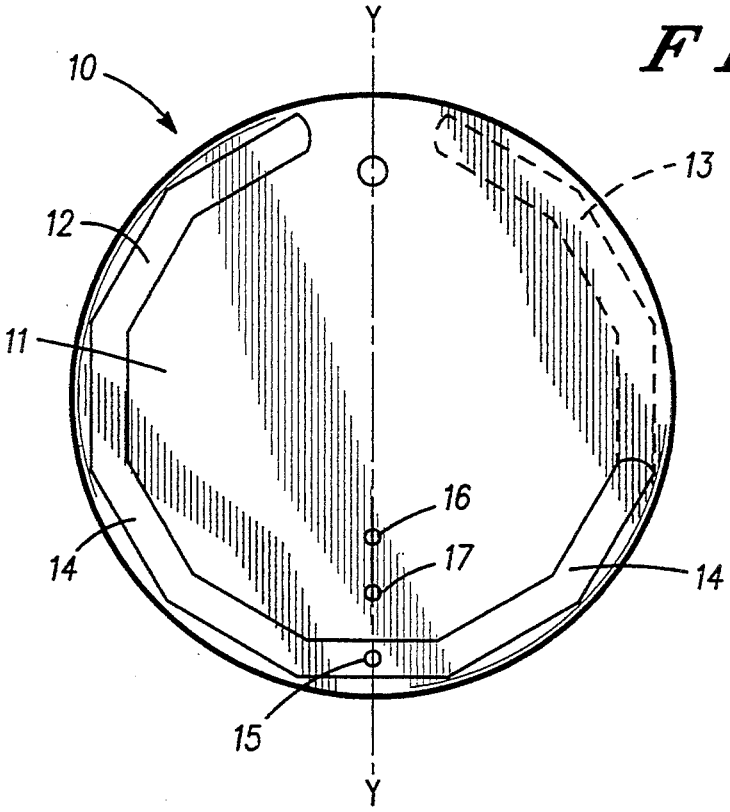
FIG. 1 illustrates a plan view of a preferred embodiment of a horizontally polarized loop antenna in accordance with the invention.
Figure 2:
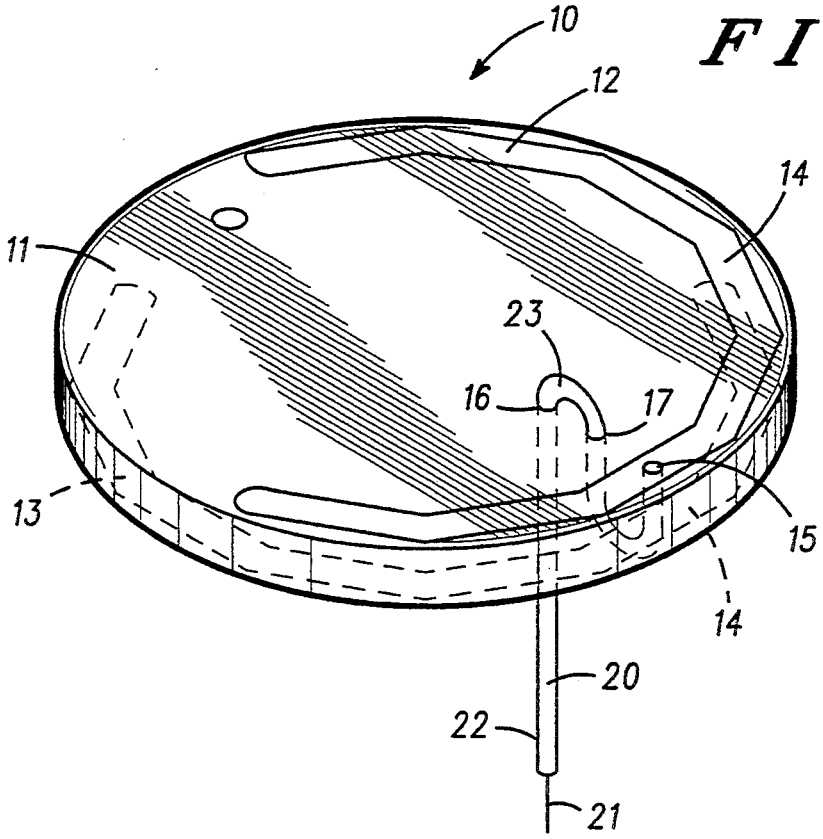
FIG. 2 illustrates a perspective view of the antenna of FIG. 1.

With reference to FIG. 1 and 2, there is illustrated a horizontally polarized loop antenna 10 designed for operation within the 920–960 MHz frequency range, although it could equally as well be adapted and used for operation at other frequencies e.g. 800 MHz, by altering the dimensions of the loop of the antenna 10 in proportion to the wavelength, λ, as would be appreciated by one skilled in the art. The antenna 10 is situated upon a substrate 11, such as the dielectric substrate of a printed circuit board (PCB), with suitable dimensions to accommodate the loop of the antenna. For the specified frequency range of between 920–960 MHz, the loop of the antenna is about 5.5 cm in diameter (equivalent to a free-space quarter wavelength (λ/4) of 8.5 cm).

The antenna 10 comprises a transmission line section and radiating section coupled thereto. The transmission line section is a balanced/unbalanced ("balun") transformer 14 coupled to an unbalanced line 20, such as, for example, a coaxial cable. It should be immediately appreciated by one skilled in the art that the unbalanced line properties of coaxial cable are often utilized at the specified operating frequencies and that alternative forms of providing an unbalanced line, such as a microstrip line or a waveguide, could be substituted therefor. The radiating section comprises an upper 12 and lower 13 radiating antenna section. The balun 14 and the upper 12 and lower 13 radiating antenna sections are constructed from copper conducting tracks deposited on the substrate 11. The conducting tracks can alternatively be made from any good conducting/radiating material e.g. aluminium or gold. It is not intended that the specific reference to a 'conducting track' should be limited to a track deposited upon a substrate. The term is equally applicable to any conducting line e.g. a free standing conductor or a wire and should therefore be construed accordingly.

An upper copper conducting track is deposited about the edge of an upper surface of the substrate 11. This copper conducting track circumscribes two-thirds of the edge of the substrate 11 and is designated for a first half of the balun 14 and the upper radiating section 12 of the antenna 10. A lower copper conducting track, forming a second half of the balun 14 and the lower radiating antenna section 13, is deposited over about two-thirds of the edge of an under surface of the substrate 11 in order to mirror the upper conducting track over a portion of its length. In the preferred embodiment, the deposition of the upper and lower conducting tracks is in a dodecahedral configuration; thus resembling a portion of a circle. The deposition of the lower conducting track is such that an overlap of approximately 150° of arc occurs between the upper and lower conducting tracks; therein forming the balun 14 and transmission line section. At the mid-point of the overlapping sections, a first hole 15 is drilled through the substrate 11 to allow coupling of an unbalanced line (in the form of the coaxial cable 20). Therefore, if the assembly is viewed as a superposition, the upper and lower copper conducting tracks form the two radiating antenna sections 12 and 13, separated by the balun (or transmission line section) 14 of mirrored, overlaid conducting tracks. For the preferred embodiment of the loop antenna 10, there is a small section of approximately 30° of arc where no conducting track overlay occurs.

Two further holes 16 and 17, with diameters substantially identical to the diameter of the coaxial cable 20, are drilled close together along the major axis Y—Y which bisects the first hole 14 and divides the balun 14 into two equal parts. Strain relief 23 for the coaxial cable 20 is achieved by looping the coaxial cable 20 through these holes 16 and 17 as illustrated. The central lead wire 21 of the coaxial cable 20 is fed through hole 15, and is coupled to the upper conducting track of balun 14 at node 30, shown in FIG. 3. The earth sheath 22 is coupled to the lower conducting track of the balun 14 at node 31.

With detailed reference to the linear model of the horizontally polarized loop antenna 10 shown in FIG. 3, it can be seen that the overlaid conducting track acts as a transmission line and, consequentially, forms the balun 14. An unbalanced line (the coaxial cable 20) feeds the balanced twin-line at the nodes 30 and 31. This point has a symmetrical loading of two quarter wave ($\lambda/4$) radiating sections. Balanced electrical currents I and I' are created within the transmission line. These currents feed the upper and lower radiating antenna sections 12 and 13. Since the currents within the radiating antenna sections are parallel and in the same direction, an antenna with an optimum radiating effect is created. It should be noted that the overall length L of both the upper and lower transmission line section of the balun 14 in combination with either upper 12 or lower 13 radiating section, i.e. the length of each conducting track, is a quarter of the free-space wavelength $\lambda/4$. Moreover, the balun 14 is composed of two symmetric transmission line sections each with an electrical length (the length of the wave within the substrate) of approximately $\lambda/4$. This reduced electrical length is the result of the higher relative permittivity, $\epsilon_r$, of the substrate 11 (typically $\epsilon_r \sim 4.5$ for a PCB) in comparison with that of free-space. In general, the balancing action of the antenna is achieved through the symmetry of the antenna design, wherein the transmission line (balun) section acts as an inductive transformer.

Since each conducting track, of length L, has a wavelength of approximately $\lambda/4$, each has an impedance close to that of a monopole antenna i.e. 25Ω. In order to create the 50Ω impedance required by the configuration in its entirety, the impedance at respective feed points A and B of each quarter wavelength $\lambda/4$ transmission line section is increased to 100Ω at node 30. Therefore, the parallel combination of these two points achieves a 50Ω matching of the coaxial cable 20 since each $\lambda/4$ transmission line section acts as a 4:1 transformer. It should be appreciated by one skilled in the art that the length of conducting track L may be trimmed, as necessary, in order to achieve optimum antenna performance. Furthermore, since the impedance of the antenna can be altered by both the close proximity of objects (typically those within ~1 cm) and any protective casing encapsulating the antenna, trimming techniques can be employed in order to tune the antenna in situ. Experiments have shown that a VSWR of 2:1 or better can be achieved for this antenna.

With reference to FIG. 4, the azimuthal radiation pattern for the horizontally polarized loop antenna 10 is illustrated. A radiation profile with approximately 1.5 dB nulls at the sides of the antenna 10 is produced. The dimensions of the antenna 10 are not small enough to provide the ideal radiation pattern of a small loop antenna, although the radiation pattern does resemble the ideal characteristics for an omnidirectional antenna.

The horizontally polarized loop antenna 10 has a theoretical efficiency at more than 90%. The factor most critical in obtaining such a desirable result is related to the type and length of coaxial (feeder) cable 20. Experimentation has shown that when a 30.24 cm RG-404 coaxial cable, with a loss of 0.4 dB, is coupled to the horizontally polarized loop antenna 10, the antenna efficiency is greater than 80% even with a worst case measurement accuracy of ±1 dB. This efficiency can be approximated from the radiation pattern results of FIG. 4. In addition, the maximum theoretical gain for a small loop antenna of this size is 2 $dB_i$. The recorded gain for the horizontally polarized loop antenna 10 was also found to be 2 dB above the isotropic antenna gain i.e. 2 $dB_i$.

Experimental results indicate that loading of the balun 14 or radiating sections 12 and 13 of the antenna 10 by either external objects or as a result of the local environment, changes the return loss by less than 0.5 dB. An initial VSWR of 1.92:1 yielded a return loss of 10 dB, whereas after loading, a VSWR of 2:1 yielded a return loss of 9.5 dB. This result indicates that the horizontally polarized loop antenna 10 has an extremely stable radiating pattern. Furthermore, impedance loading of the coaxial (feeder) cable altered the return loss by less than 0.5 dB, indicating a parasitic current within the feeder cable of less than 4% and a cross polarization of at least −14 dB. The cross polarization was, in fact, measured at ~−20 dB. A bandwidth of 10–15% of a central operating frequency, $f_o$, was achieved for a VSWR of 2:1. This bandwidth is significantly better than the typical 2–3% bandwidth achieved by a prior art microstrip antenna. For a tuned transmission frequency of 928 MHz, a VSWR of 1.5:1 yielded a return loss of better than −14 dB (~4% loss to the generator). At a receiver frequency of 952 MHz, a VSWR of 2.2:1 yielded a return loss of ~8−9 dB.

An alternative embodiment of the present invention provides for the extension of the horizontally polarized loop antenna 10 to a dual polarization operating mode. The horizontally polarized loop antenna 10 is integrated with a collinear dipole antenna to create a dual polarization antenna, having horizontally and vertically polarized radiating fields, without external couplers.

With reference to FIG. 5, a prior art collinear dipole antenna is described. The collinear dipole antenna 40, is a λ/2 dipole antenna constructed from a coaxial cable 41. The central lead wire 42 of the coaxial cable 41 provides a first λ/4 radiating arm 44, whilst the outer earth shield 43 provides a second radiating arm 45 of length λ/4. Such a configuration ensures that the electric current directions within the collinear dipole antenna 40 are aligned. A choke 46, in the form of a loop of coaxial cable, restricts radiating current from the coaxial cable 41 by presenting a high impedance to the current on the outer earth sheath 43. This high impedance choke 46 allows the outer earth sheath 43 to act as a radiating section and, therefore, produces the collinear dipole antenna 40.

With reference to FIG. 6, there is shown a conformal omnidirectional dual polarization antenna 60 formed by a combination of the horizontally polarised loop antenna 10 of FIG. 1 and the collinear dipole antenna 40 of FIG. 5. The coaxial cable 41 of the collinear dipole antenna 40 provides a common unbalanced feed line for both the horizontally polarized loop antenna 10 and the collinear dipole antenna 40. The dipole antenna 40 can be affixed to the loop antenna 10 by threading the first radiating arm 44 of the dipole 40 through the hole 15 which penetrates the balun 14 and the substrate of the loop antenna 10. The dipole antenna 40 and loop antenna 10 are then coupled together by, first, coupling the outer earth sheath 43 of the lower λ/4 radiating arm 45, of dipole antenna 40, to node 31 located on the lower conducting track 13 of the balun 14. Second, the central lead wire 42, which forms the upper λ/4 radiating section 44 of the dipole antenna 40, is coupled to node 30, located on the upper conducting track 12 of the balun 14 of the loop antenna 10. Thus, each conducting track on the loop antenna 10 receives a different potential.

Since the input impedances of the horizontally polarized loop antenna 10 and the collinear dipole antenna 40 are in parallel, the overall lengths of each component antenna must be increased in order to compensate for the lower impedance created by this parallel configuration. It should be noted that neither an external power splitter nor an external coupler is required to implement the conformal omnidirectional dual polarization antenna of FIG. 6 since both antennas have the same radiation phase center. In addition, since the requirement for power splitters and external couplers within the antenna has been eliminated, the losses associated with the external components therein have been eliminated, and overall efficiency of the conformal omnidirectional dual polarization antenna has been increased. A conformal omnidirectional dual polarization antenna 60 configured in such a way creates the attributes of polarization diversity, which is important within indoor antenna applications, and provides a means for detecting horizontal, vertical and circular polarizations and polarizations therebetween.

It can clearly be appreciated that antennas so designed and described produce the novel advantages of small, low profile, low cost, conformal antenna suitable, for example, as concealed radiators inside equipment. Additionally, the limited near field dimensions of such antennas produce immunity from interference from nearby metal objects. A further benefit arising from this high interference immunity manifests itself it that the antennas may be encased in dense protective environments and, in addition, can be mounted on non-conductive surfaces. Such antennas lend themselves to the application within the 800–960 MHz frequency range and, particularly, to indoor application where outside antenna installation is either impractical or undesired. Furthermore, the requirement for tuning components, such as capacitors and inductors, and power splitters within conformal omnidirectional dual polarization antennas is eliminated by the direct coupling method employed between the horizontally polarized loop antenna and a prior art collinear antenna. Moreover, such antenna can achieve impedance matching to 50Ω, for example, without the use of external components.

It will, of course, be understood that the above description has been given by way of example only, and that modifications in detail, such as the use of alternative methods of supplying an unbalanced line e.g. through the use of microstrip lines, may be made within the scope of the invention. Furthermore, it should be appreciated that the inventive concept of such an antenna configuration is equally applicable to a linear dipole antenna arrangement. In addition, the substrate on which the the balanced/unbalanced transformer is formed may be replaced by an equivalent method of transmission line separation. Moreover, the configuration of the antenna and coupling techniques utilised within the preferred embodiment serve equally as well within alternative frequency applications which depart from those specified.

I claim:

1. An antenna comprising:

a) a substrate having an upper surface and a lower surface;

b) a transformer formed on the substrate and having a first arced conducting track on the upper surface and a second arced conducting track, mirroring the first conducting track, on the lower surface, said first and second arced conducting tracks having an overlapping portion and at least one of said first and second conducting tracks having a further portion which extends beyond said overlapping portion, said further portion providing a radiating section;

c) a collinear dipole element providing an unbalanced line providing a first potential and a second potential; and wherein:

the first potential and the second potential are coupled centrally to said first and second conducting tracks respectively.

2. An antenna in accordance with claim 1, wherein the unbalanced line is a coaxial cable.

3. An antenna in accordance with claim 1, wherein the combined length of the overlapping portion of the arced conducting tracks and the radiating section is approximately a quarter of the free space wavelength of the antenna.

4. An antenna in accordance with claim 1, wherein the substance is a printed circuit board.

5. An antenna in accordance with claim 1, wherein the second arced conducting track of the overlapping portion mirrors the first arced conducting track for a distance of approximately half a wavelength of a wave within the substrate.

6. A conformal omnidirectional dual polarization antenna comprising:

a) an antenna containing:

i) a substrate having an upper surface and a lower surface;

ii) a transformer formed on the substrate and having a first arced conducting track on the upper surface and a second conducting track, mirroring the first arced conducting track on the lower surface, said first and second arced conducting tracks having an overlapping portion and at least one of said first and second arced conducting tracks having a further portion which extends beyond said overlapping portion, said further portion providing a radiating section;

b) a collinear dipole antenna having an unbalanced line which provides a first potential and a second potential; and wherein said first potential and said second potential couple and supply said first and second arced conducting tracks respectively, thereby forming the dual polarization antenna.

7. An antenna in accordance with claim 6, wherein the combined length of the overlapping portion of the arced conducting tracks and the radiating section is approximately a quarter of the free space wavelength of the antenna.

8. A antenna in accordance with claim 6, wherein the coupling and supply of said first and second potentials to said first and second arced conducting tracks occurs at a symmetric center of each respective conducting track.

9. A conformal omnidirectional dual polarization antenna in accordance with claim 6, wherein coupling between said antennas occurs at a distance of a quarter of the free space wavelength of the antenna from the top of the collinear dipole antenna.

10. An antenna in accordance with claim 6, wherein the substrate is a printed circuit board.

11. A method of manufacturing an antenna comprising the steps of:

a) forming a transformer on upper and lower opposite surfaces of a substrate, wherein the transformer comprises first and second arced conducting tracks and said first arced conducting track, coupled to said upper surface, mirrors said second arced conducting track, coupled to said lower surface;

b) forming a radiating section, for radiating electromagnetic radiation, the radiating section including upper and lower radiation sections located on opposite surfaces of said substrate and the upper radiation section is formed by a portion of the first arced conducting track which does not mirror the second arced conducting track and the lower radiation section is formed by a portion of the second arced conducting track which does not mirror the first conducting track; and c) providing an unbalanced collinear dipole element, having first and second potentials coupled to opposite surfaces of said transformer and respectively centrally coupling said first and second potentials thereof to said first and second arced conducting tracks, whereby said radiating section radiates electromagnetic radiation.

12. An antenna comprising:

a) a substrate having an upper surface and a lower surface;

b) a first arced conducting track on said upper surface and a second arced conducting track on said lower surface, wherein a first portion of said first arced conducting track overlays a first portion of said second arced conducting track, thereby forming an overlaid portion of said second arced conducting track;

c) a collinear dipole element providing an unbalanced line providing a first potential and a second potential, said first and second potentials being respectively coupled to said first and second arced conducting tracks; and d) an arced radiating conducting track connected to said overlaid portion, thereby forming a radiating section for radiating electromagnetic radiation in response to the application of said first and second potentials.

13. An antenna in accordance with claim 12, wherein the substrate is a printed circuit board.

14. An antenna in accordance with claim 13, wherein the combined length of an arced conducting track and an arced radiating conducting track is approximately a quarter of the free space wavelength of the antenna.

15. An antenna in accordance with claim 13, wherein the first arced conducting track overlays the second arced conducting track for a distance of approximately half a wavelength of a wave within the substrate.

* * * * *

UNITED STATES PATENT AND TRADEMARK OFFICE

CERTIFICATE OF CORRECTION

PATENT NO. : 5,426,439

DATED : June 20, 1995

INVENTOR(S) : Ovadia Grossman

It is certified that error appears in the above-indentified patent and that said Letters Patent is hereby corrected as shown below:

Column 7, line 3, between "second" and "conducting", insert – arced –.

Signed and Sealed this

Seventeenth Day of October, 1995

*Attest:*

Bruce Lehman

BRUCE LEHMAN

*Attesting Officer*

*Commissioner of Patents and Trademarks*